US011591708B2

(12) United States Patent
Bian et al.

(10) Patent No.: US 11,591,708 B2
(45) Date of Patent: Feb. 28, 2023

(54) ENTROPY-STABILIZED CERAMIC THIN FILM COATING, METHOD FOR PREPARING THE SAME, AND COMPONENT COATED WITH THE SAME

(71) Applicant: City University of Hong Kong, Kowloon (HK)

(72) Inventors: Haidong Bian, Kowloon (HK); Quanfeng He, Kowloon (HK); Zebiao Li, Kowloon (HK); Jian Lu, Kowloon (HK); Yong Yang, Kowloon (HK); Yang Yang Li, Kowloon (HK)

(73) Assignee: City University of Hong Kong, Kowloon (HK)

( * ) Notice: Subject to any disclaimer, the term of this patent is extended or adjusted under 35 U.S.C. 154(b) by 160 days.

(21) Appl. No.: 16/391,753

(22) Filed: Apr. 23, 2019

(65) Prior Publication Data

US 2020/0340135 A1 Oct. 29, 2020

(51) Int. Cl.
*C25D 11/26* (2006.01)

(52) U.S. Cl.
CPC ..... *C25D 11/26* (2013.01)

(58) Field of Classification Search
None
See application file for complete search history.

(56) References Cited

FOREIGN PATENT DOCUMENTS

| | | | | |
|---|---|---|---|---|
| CN | 105714353 | * | 4/2018 | ..... C25D 11/02 |
| CN | 109252199 | * | 1/2019 | ..... C25D 11/02 |
| CN | 109621008 | * | 4/2019 | ..... A61L 27/32 |
| WO | WO2015102142 | * | 7/2015 | ..... C25D 11/243 |

OTHER PUBLICATIONS

Yavari et al.,"Crystal structure and nanotopographical features on the surface of heat-treated and anodized porous titanium biomaterials produced using selective laser melting", Applied Surface Science, 290, p. 287-294, 2014. (Year: 2014).*

Diamanti et al., "Multi-step anodizing on Ti6Al4V components to improve tribomechanical performances", Surface & Coatings Technology, p. 19-27, 2013. (Year: 2013).*

Murad, "Investigating corrosion behaviors of anodized metallic implants by electrochemical analysis", Thesis, Wichita State University, 2016. (Year: 2016).*

Lei et al. "Ultrastable metal oxide nanotube arrays achieved by entropy-stabilization engineering" Scripta Materialia, 146, 2018, 340-343 (Year: 2018).*

English Translation (Espacenet) CN 105714353. (Year: 2016).*

* cited by examiner

*Primary Examiner* — Stefanie S Wittenberg
(74) *Attorney, Agent, or Firm* — Renner Kenner Greive Bobak Taylor & Weber

(57) ABSTRACT

A method for preparing an entropy-stabilized ceramic thin film coating includes preparing a first layer formed by raw materials with a plurality of metal elements, and subjecting the first layer to reaction with anion thereby transforming at least a portion of the first layer to a second layer. The present invention also discloses an entropy-stabilized ceramic thin film coating and a component coated with an entropy-stabilized ceramic thin film coating.

10 Claims, 11 Drawing Sheets

ENTROPY-STABILIZED CERAMIC THIN FILM COATING, METHOD FOR PREPARING THE SAME, AND COMPONENT COATED WITH THE SAME

FIELD OF INVENTION

The invention relates to an entropy-stabilized ceramic thin film coating, a method for preparing the same, and a component coated with the same.

BACKGROUND

Entropy-stabilized ceramics possess attractive physical and mechanical properties. Currently, fabrication methods are limited to additive methods such as sputtering, laser-cladding, nebulized spray pyrolysis, or high-temperature sintering processes. However, such fabrication methods have several insurmountable limitations. For instance, these entropy-stabilized ceramics technologies generally require expensive equipment such as vacuum, protective gases or sophisticated control systems. In addition, these technologies offer only small-area fabrication with low uniformity, small scale production, and in fact it is a highly tedious fabrication process. As a result, entropy-stabilized ceramics are merely applicable to a few entropy-stabilized alloys and it is not suitable for commercialization.

SUMMARY OF INVENTION

In an aspect of the invention, there is provided a method for preparing entropy-stabilized ceramic thin film coating, comprising the steps of:

a) preparing the first layer formed by raw materials with a plurality of metal elements; and b) subjecting the first layer to reaction with anion thereby transforming at least a portion of the first layer to a second layer.

In one embodiment, the first layer is arranged to react with anion in a top-down manner.

In one embodiment, the raw materials are provided in approximately equal atomic ratios.

In one embodiment, the raw materials are selected from Titanium, Aluminium, Vanadium, Chromium, and Niobium.

In one embodiment, the raw materials have a high purity of >99.99%.

In one embodiment, the second layer is tightly bonded to the first layer.

In one embodiment, step b) further includes the step of forming a mesoporous structure between the first and second layers.

In one embodiment, the physical property of the thin film is associated with the morphologies of the mesoporous structure.

In one embodiment, the mesoporous structure includes pore size ranged from 10 to 50 nm.

In one embodiment, the first layer includes entropy-stabilized alloys

In one embodiment, the entropy-stabilized alloys are selected from TiAlV, TiAlVCr and TiAlVNbCr.

In one embodiment, step b) further includes the step of anodizing the first layer with the anion to form the second layer.

In one embodiment, the anion is incorporated in the lattice of the first layer under the electric field of the anodization to form the second layer.

In one embodiment, the anion includes oxygen anion.

In one embodiment, the second layer includes an oxide.

In one embodiment, the physical property of the thin film is manipulated by at least one of anodization potential, type of electrolyte, concentration of electrolyte, and duration of anodization.

In one embodiment, the anodization potential is ranged from 10 to 100V.

In one embodiment, the electrolyte includes an acid solution.

In a further aspect of the invention, there is provided an entropy-stabilized ceramic thin film coating prepared according to the method described herein.

In one embodiment, the hardness is between 9 to 14 GPa.

In one embodiment, the reduced modulus is between 140 to 190 GPa.

In a yet further aspect of the invention, there is provided a component coated with an entropy-stabilized ceramic thin film coating described herein.

BRIEF DESCRIPTION OF DRAWINGS

It will be convenient to further describe the present invention with respect to the accompanying drawings that illustrate possible arrangements of the invention. Other arrangements of the invention are possible, and consequently the particularity of the accompanying drawings is not to be understood as superseding the generality of the preceding description of the invention.

DETAILED DESCRIPTION

Without wishing to be bound by theories, the inventors, through their own researches, trials and experiments, have devised that although entropy-stabilized ceramics possess attractive mechanical and physical performance, there is no practical methods of preparing entropy-stabilized ceramics that is applicable for industry applications.

The inventors identified that one of the main reasons is that, the major entropy-stabilized ceramics components are usually fabricated by combining metal salts or metal ceramics i.e. "bottom-up" methods. Expensive equipment such as vacuum, protective gases or sophisticated control systems, long-time high temperature treatments, and/or complicated synthesis process are usually required to obtain entropy-stabilized ceramics, which inevitably increase the fabrication cost of entropy-stabilized ceramics and restrict their practical applications.

In the present invention, the inventors have devised an entirely novel, rapid yet facile and economical method which requires much less energy consumption for producing entropy-stabilized ceramic films.

Figure 1B:
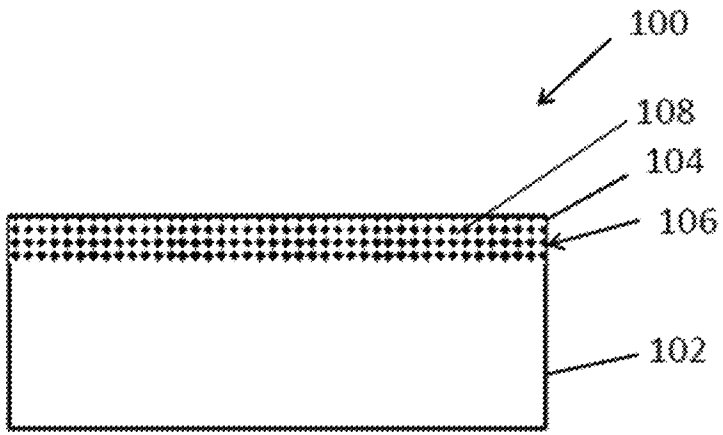
FIG. 1*b* illustrates an entropy-stabilized ceramic in one example embodiment of the invention.
Figure 1A:
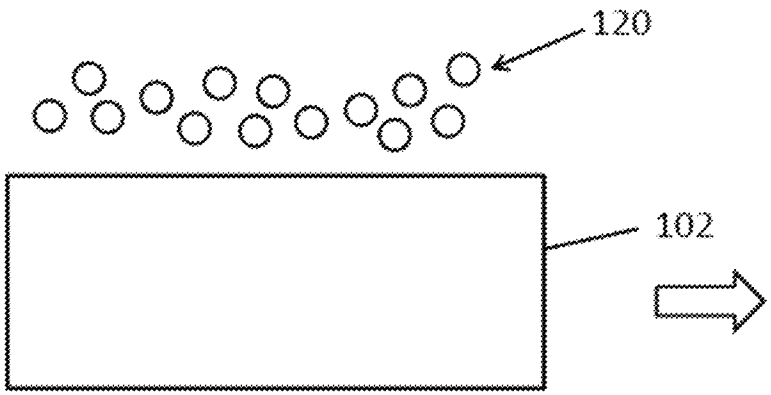
FIG. 1*a* illustrates an entropy-stabilized alloy and anion in reaction for preparing an entropy-stabilized ceramics in one example embodiment of the invention.

Referring initially to FIGS. 1*a* to 1*b*, there is provided a method for preparing an entropy-stabilized ceramic thin film coating 100, comprising the steps of: preparing a first layer 102 formed by raw materials having a plurality of metal elements; and subjecting the first layer 102 to reaction with anion 120 thereby transforming at least a portion of the first layer 102 to a second layer 104.

Turning now to the detailed structure of the thin film coating 100, the thin film coating 100 preferably includes at least two layers, a first layer 102 serving as a substrate and a second layer 104 formed on top of the first layer 102 as a coating, and a mesoporous structure 106 sandwiched between the first and second layers 102, 104.

The first layer 102 may be formed by alloy materials e.g. a wide range of entropy-stabilized alloys e.g. TiAlV, TiAlVCr and TiAlVNbCr made of raw materials selected from a plurality of metals e.g. Titanium, Aluminium, Vanadium, Chromium and Niobium with approximately equal atomic ratios. Preferably, the raw materials have a high plurality of greater than 99.9%.

Advantageously, such entropy-stabilized alloys are defined as solid solution alloys containing three or more principal elements in equal or near-equal atomic percentage. These alloys are highly stable in thermodynamics with high mixing entropy. Comparing with conventional alloys, these entropy-stabilized alloys have unique physical and mechanical properties.

To fabricate the second layer 104, the upper surface of the first layer 102 is subjected to an electrochemical reaction for partially removing the metal atoms from the first layer 102 in a "top-down" manner i.e. from top to bottom. A second layer 104 would be formed and tightly bonded to the first layer 102 underneath.

For instance, the first layer 102 may be anodized with an anion 120 e.g. oxygen anion or sulfur anion. By anodizing the entropy-stabilized alloy which forms the first layer 102 with oxygen anions or sulfur anions 120, the anions 120 may be incorporated into the lattice of the first layer 102 under electrical field. In turn, the surface of the first layer 102 will form an oxide or a sulfide second layer 104 i.e. stabilized amorphous near-equimolar oxide or sulfide e.g. $TiAlVO_x$ entropy-stabilized oxide. The oxide or sulfide layer 104 would be coupled to the first layer 102 through their bonding therebetween.

To form such a mesoporous structure 106, the first layer 102 e.g. entropy-stabilized alloy may be subjected to anodization within a two-electrode cell, which typically includes a power source, a cathode, an anode, and an electrolyte. In one example arrangement, the anode may be the entropy-stabilized alloy 102, the cathode may be platinum and the electrolyte may be an acid solution e.g. oxalic acid. The anode 102 may be treated in the electrolyte for a short period of time (e.g. from a few minutes to a few hours).

During the anodization, the mesoporous structure 106 may directly grow on the metallic surface of the first layer 102 and thus the second layer 104 would be tightly bonded onto the first layer 102. Preferably, the mesoporous structure 106 includes a plurality of pores 108, each having a diameter ranged from 10 to 50 nm.

Figure 2A:
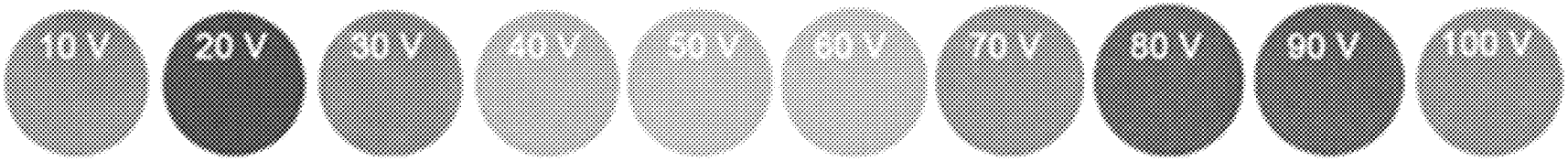
FIG. 2*a* is a set of optical photographs in greyscale depicting the applied anodization potential ranging from 10 to 100 V.
Figure 2C:
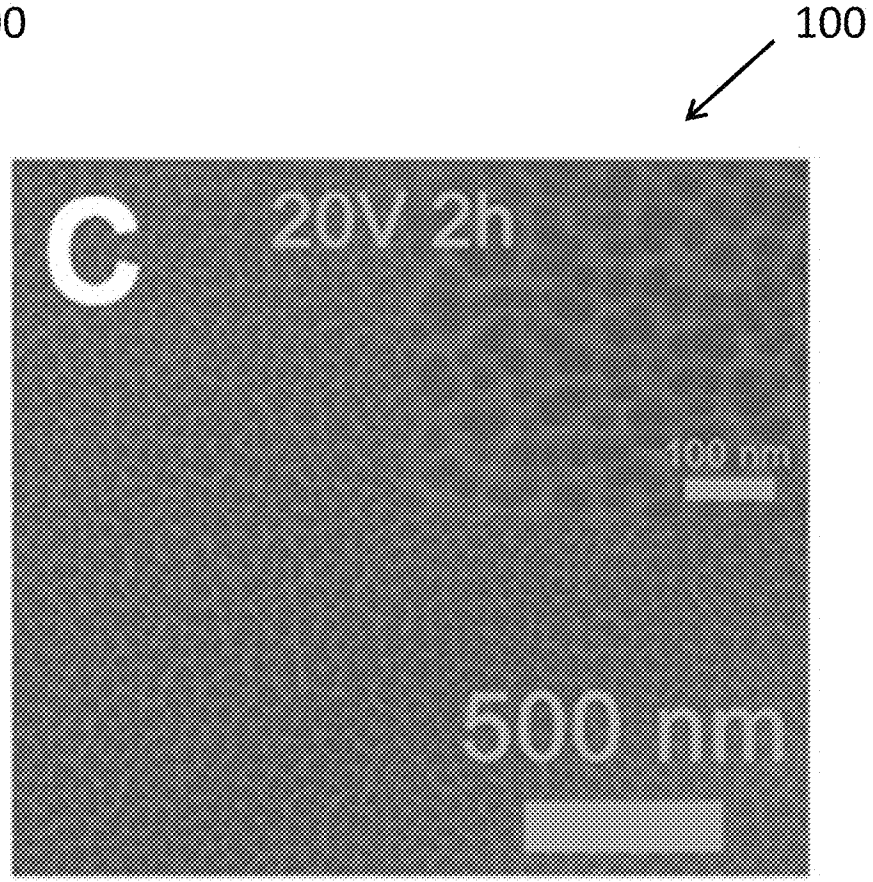
FIG. 2*c* is a top view of SEM image of an entropy-stabilized ceramic fabricated by the present method at an anodization potential of 20 V for 2 h.
Figure 2B:
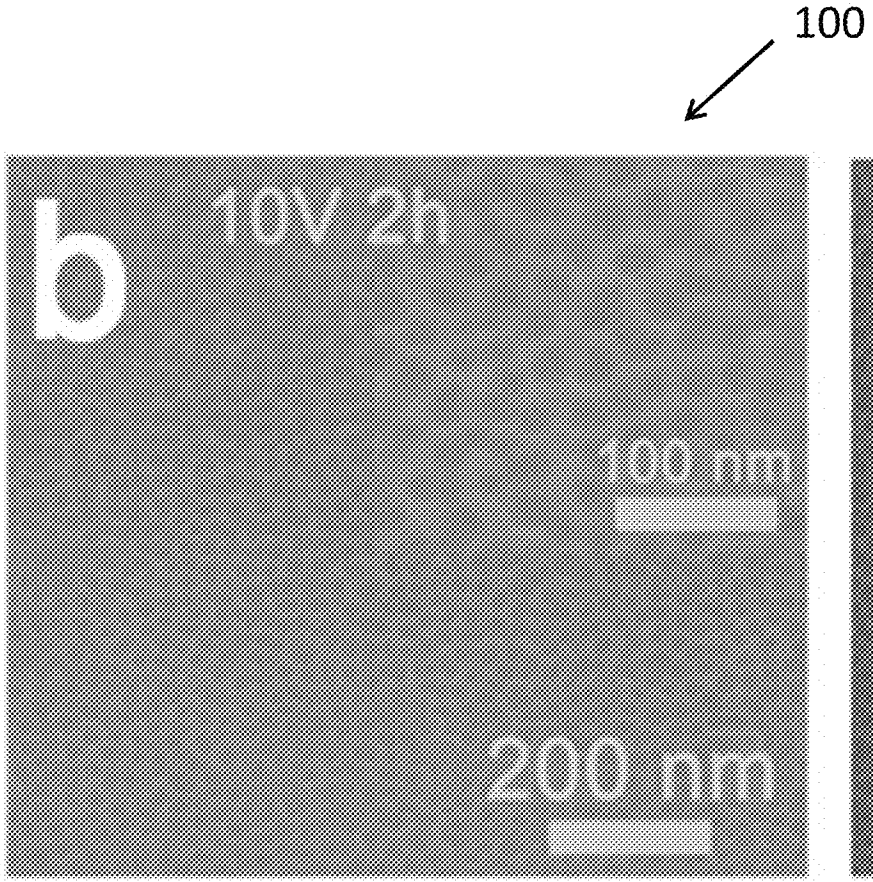
FIG. 2*b* is a top view of scanning electron microscope (SEM) image of an entropy-stabilized ceramic fabricated by the present method at an anodization potential of 10 V for 2 h.
Figure 2E:
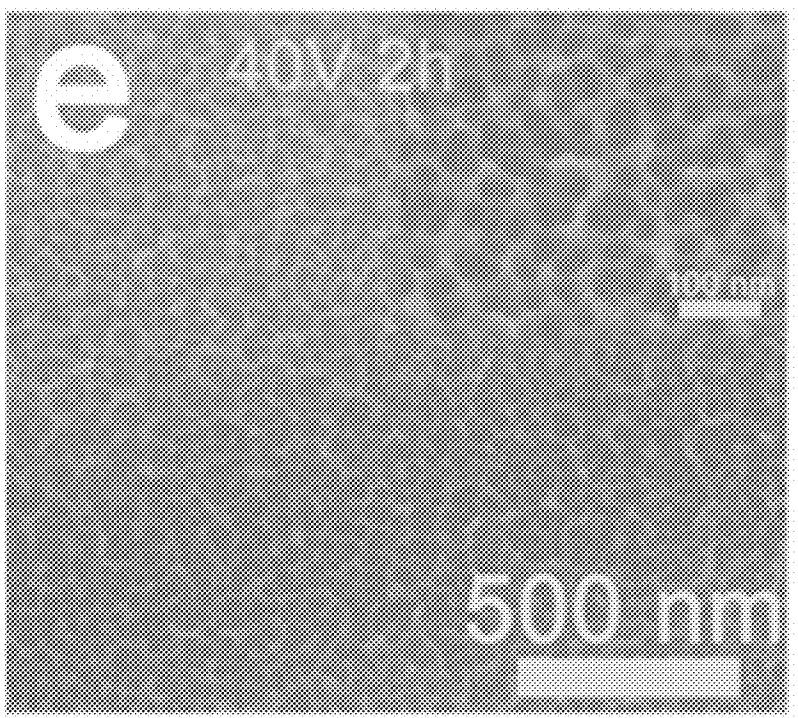
FIG. 2*e* is a top view of SEM image of an entropy-stabilized ceramic fabricated by the present method at an anodization potential of 40 V for 2 h.
Figure 2D:
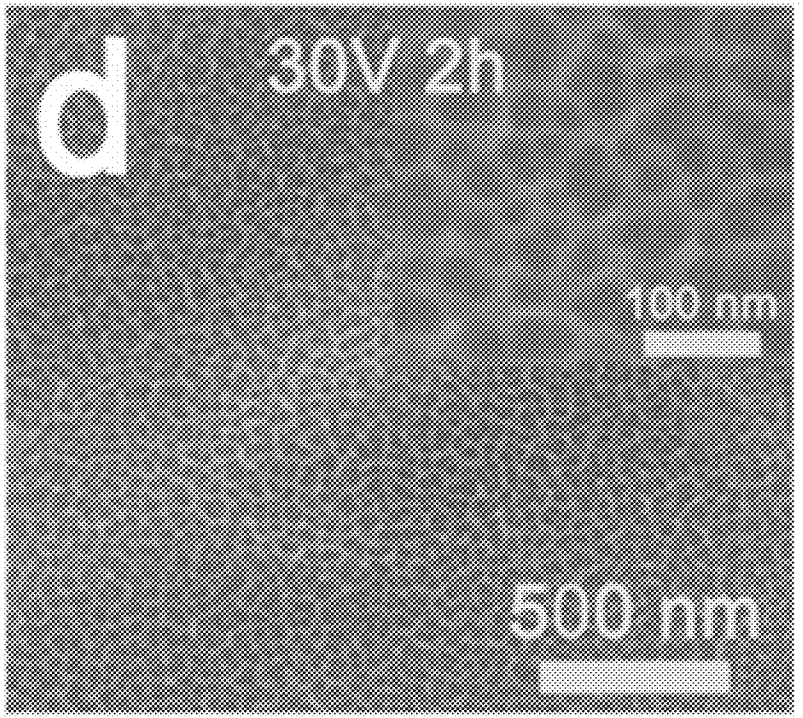
FIG. 2*d* is a top view of SEM image of an entropy-stabilized ceramic fabricated by the present method at an anodization potential of 30 V for 2 h.
Figure 2G:
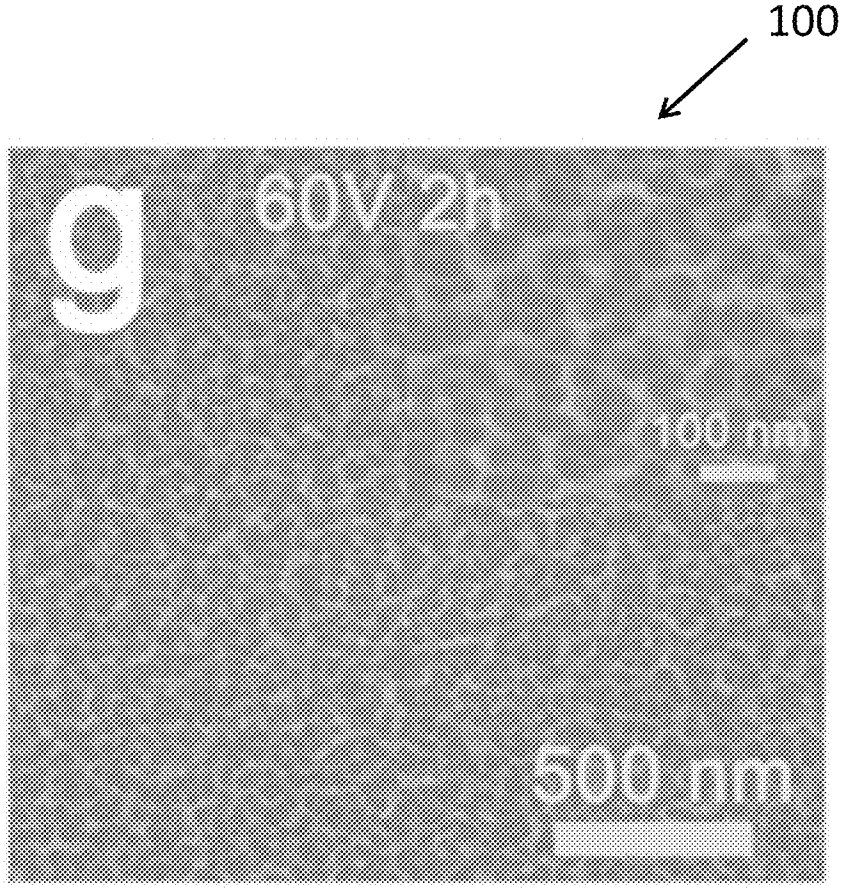
FIG. 2*g* is a top view of SEM image of an entropy-stabilized ceramic fabricated by the present method at an anodization potential of 60 V for 2 h.
Figure 2F:
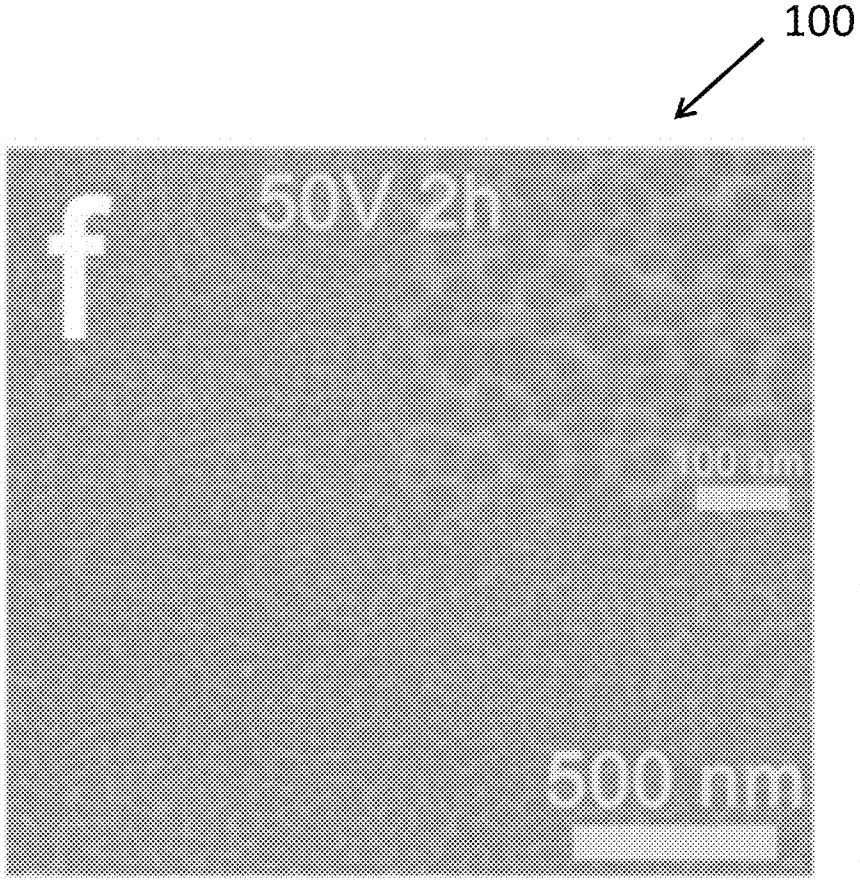
FIG. 2*f* is a top view of SEM image of an entropy-stabilized ceramic fabricated by the present method at an anodization potential of 50 V for 2 h.
Figure 2I:
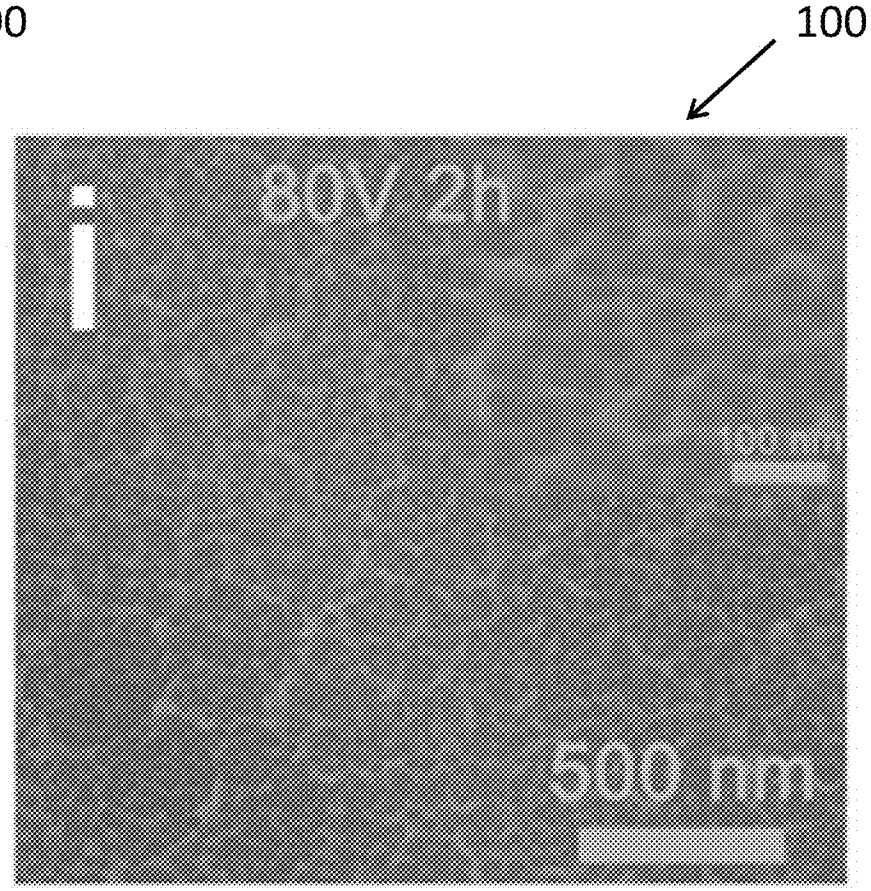
FIG. 2*i* is a top view of SEM image of an entropy-stabilized ceramic fabricated by the present method at an anodization potential of 80 V for 2 h.
Figure 2H:
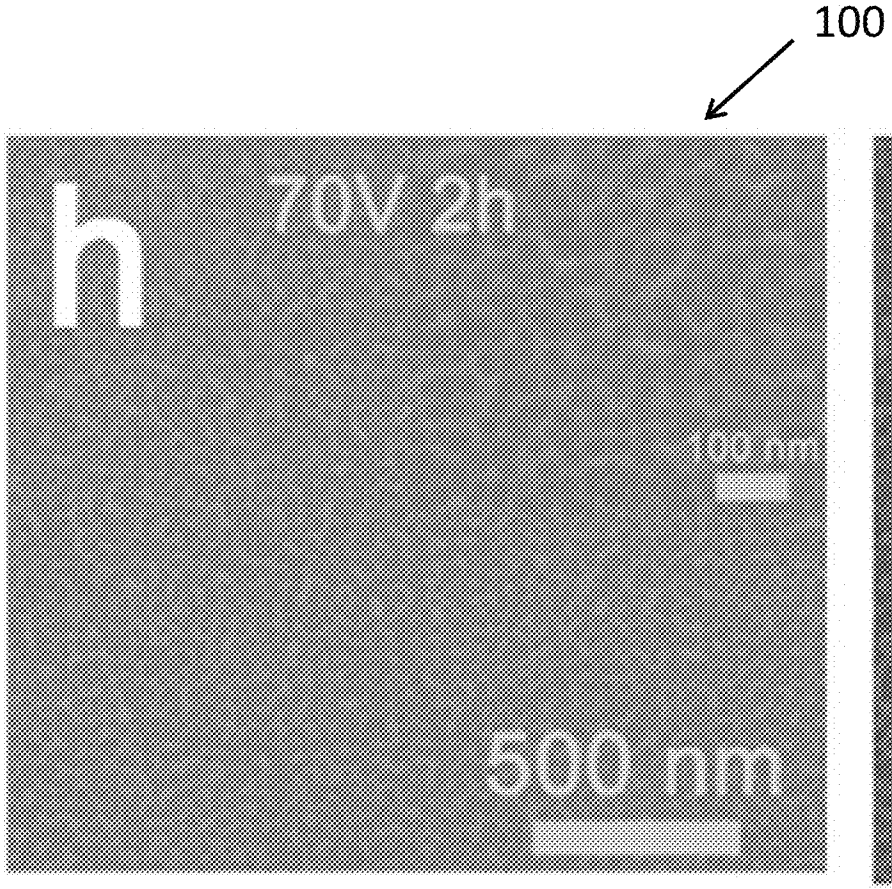
FIG. 2*h* is a top view of SEM image of an entropy-stabilized ceramic fabricated by the present method at an anodization potential of 70 V for 2 h.
Figure 2K:
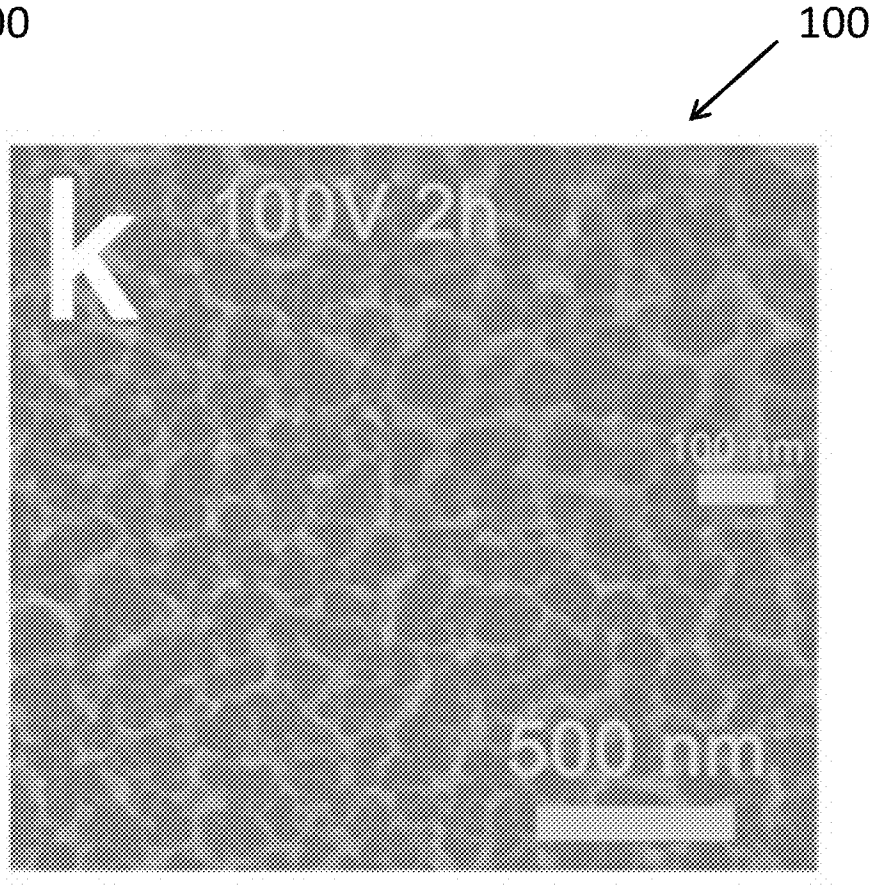
FIG. 2*k* is a top view of SEM image of an entropy-stabilized ceramic fabricated by the present method at an anodization potential of 100 V for 2 h.
Figure 2J:
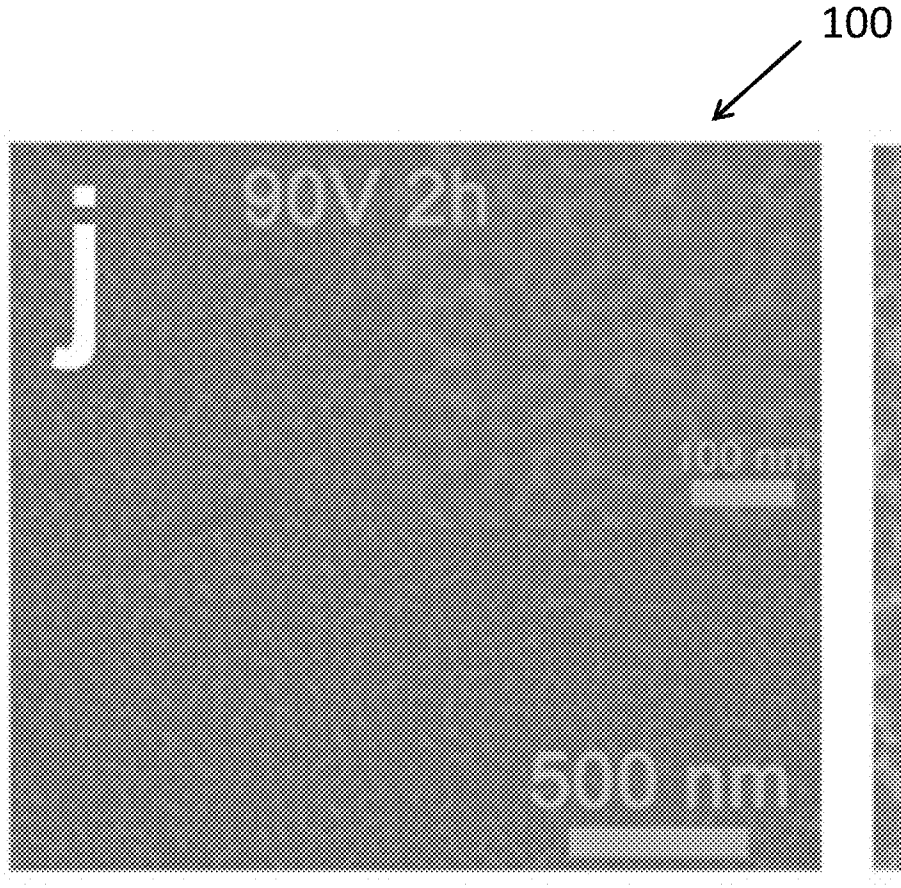
FIG. 2*j* is a top view of SEM image of an entropy-stabilized ceramic fabricated by the present method at an anodization potential of 90 V for 2 h.

Optionally, by adjusting the anodization parameters such as anodization potentials, electrolyte concentration etc., various mesoporous entropy-stabilized ceramics films 100 with different pore size, ligament width, porosity, tunable colors and mechanical properties may be obtained. For instance, the anodization may be conducted in the range of 10 to 100 V for a period ranged from several minutes to several hours and preferably each conducted for 2 hours as depicted in FIG. 2*a*. FIGS. 2*b* to 2*k* depict ten entropy-stabilized ceramics 104 with different color tones, which are fabricated under ten different anodization potential respectively.

| FIG. | Anodization Potential (V) | Color |
|---|---|---|
| 2b | 10 | Clay |
| 2c | 20 | Purple Deep |
| 2d | 30 | Prussian Blue |
| 2e | 40 | Grayish Green Deep |
| 2f | 50 | Grayish Green |
| 2g | 60 | Olive Pale |
| 2h | 70 | Orange |
| 2i | 80 | Violet |
| 2j | 90 | Marine Blue |
| 2k | 100 | Peacock Green |

Advantageously, many possible entropy-stabilized ceramics 104 may be formed by treating different entropy-stabilized alloys 102 directly in various electrolytes. Accordingly, the present invention is well suited for rapid development of new entropy-stabilized ceramics 104, for instance, by utilizing different anodization parameters and selecting different chemical substances such as the anode or the electrolyte for anodization.

Figure 3:
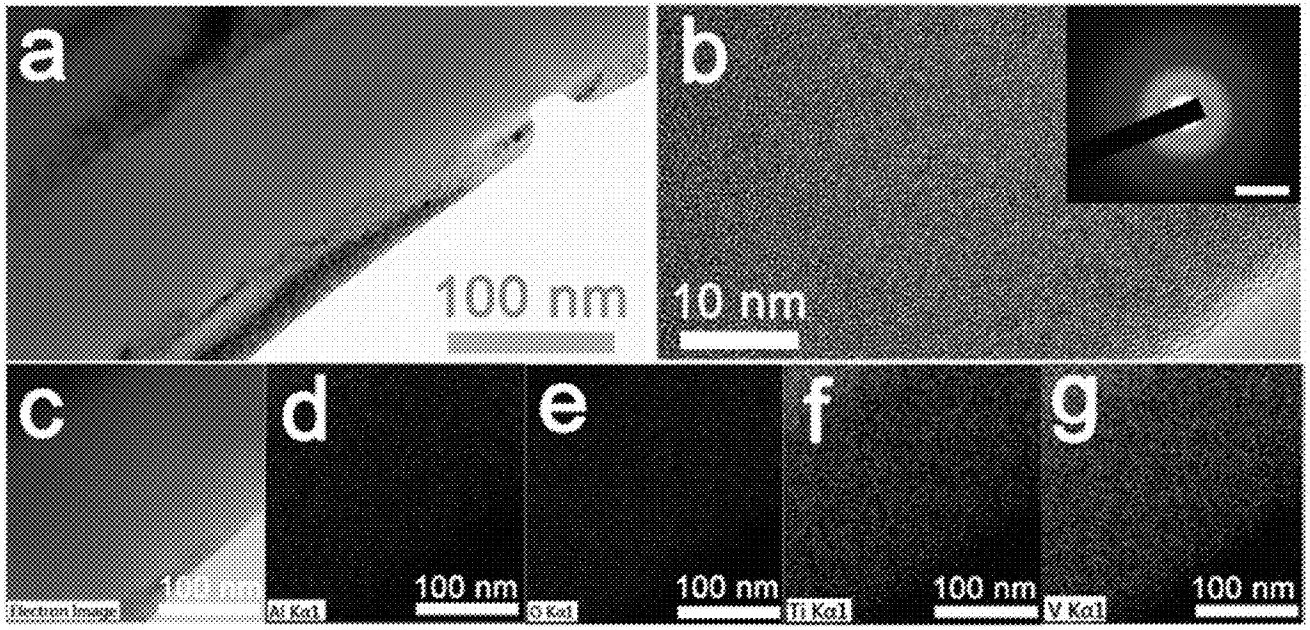
FIG. 3 provides multiple images relating to the present method, wherein: image a is of an entropy-stabilized ceramic fabricated by the present method; image b is a high-resolution transmission electron microscopy (HRTEM) image and corresponding selected-area electron diffraction (SAED) result of the entropy-stabilized ceramic of image a; image c is an energy dispersive spectroscopy (EDS) mapping image of an entropy-stabilized ceramic of image a; image d illustrates only the aluminium content of the entropy-stabilized ceramic in the EDS mapping image of image c; image e illustrates only the oxygen content of the entropy-stabilized ceramic in the EDS mapping image of image c; image f illustrates only the titanium content of the entropy-stabilized ceramic in the EDS mapping image of image c; and image g illustrates only the vanadium content of the entropy-stabilized ceramic in the EDS mapping image of image c.

In one example embodiment, a $TiAlVO_x$ system is fabricated via anodization of the present invention. Referring to FIG. 3 images a to g, the amorphous feature of the prepared entropy-stabilized ceramics 104 is revealed by HRTEM and SAED characterizations. The elemental mapping results, i.e. the electronic image of the $TiAlVO_x$ as well as each of the component elements Ti, V, Al and O presented in each corresponding EDS mapping image in the same scale, indicate the homogeneous distribution of the component elements.

Figure 4:
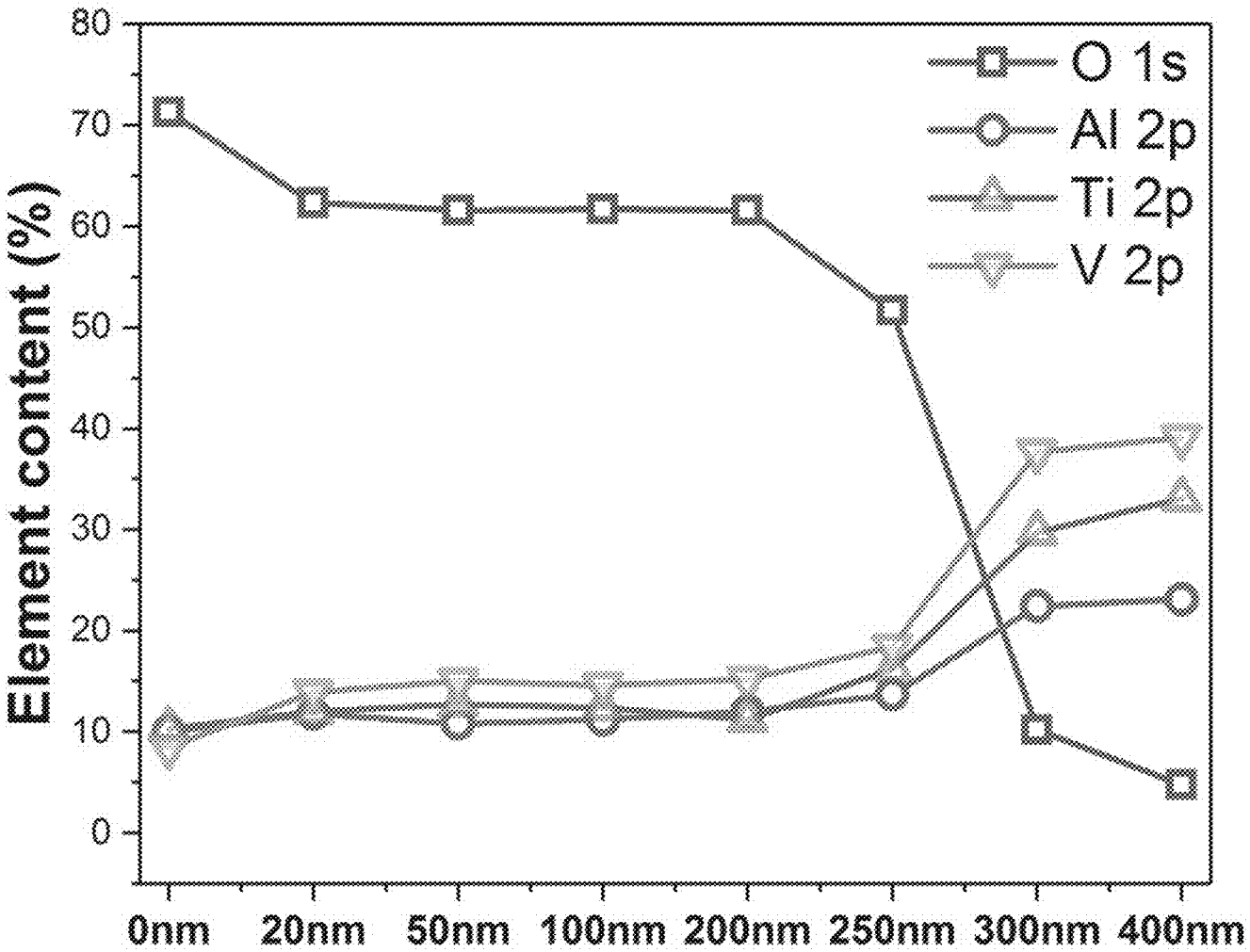
FIG. 4 is a X-ray photoelectron spectroscopy (XPS) depth profiles of as-prepared $TiAlVO_x$ entropy-stabilized oxides (ESOs) at an anodization potential of 100 V for 2 h.

Referring also to FIG. 4 for the depth analysis of the same $TiAlVO_x$ system by X-ray photoelectron spectroscopy (XPS), the element content of each element O, Ti, V and Al is plotted against the depth of the film. In particular, the three metal component elements Ti, V, Al share approximately the same element content and O has an element content that is significantly greater than these metal components from 0 nm up to 250 nm of the $TiAlVO_x$ system. This suggests that a near-equimolar composition of the metal elements of V, Ti and Al is distributed across the upper surface of the thin film 100.

Advantageously, the entropy-stabilized ceramic 104 is tightly bonded onto the entropy-stabilized alloy substrate 102. Once the ceramic 104 is bonded to the substrate 102 underneath, the mechanical properties and iridescent features e.g. visual color of the thin film 100 would be dramatically increased. Such characteristic enable many potential applications as protective or decorative coatings or coating materials such as mobile phone shells and car shells.

Figure 5A:
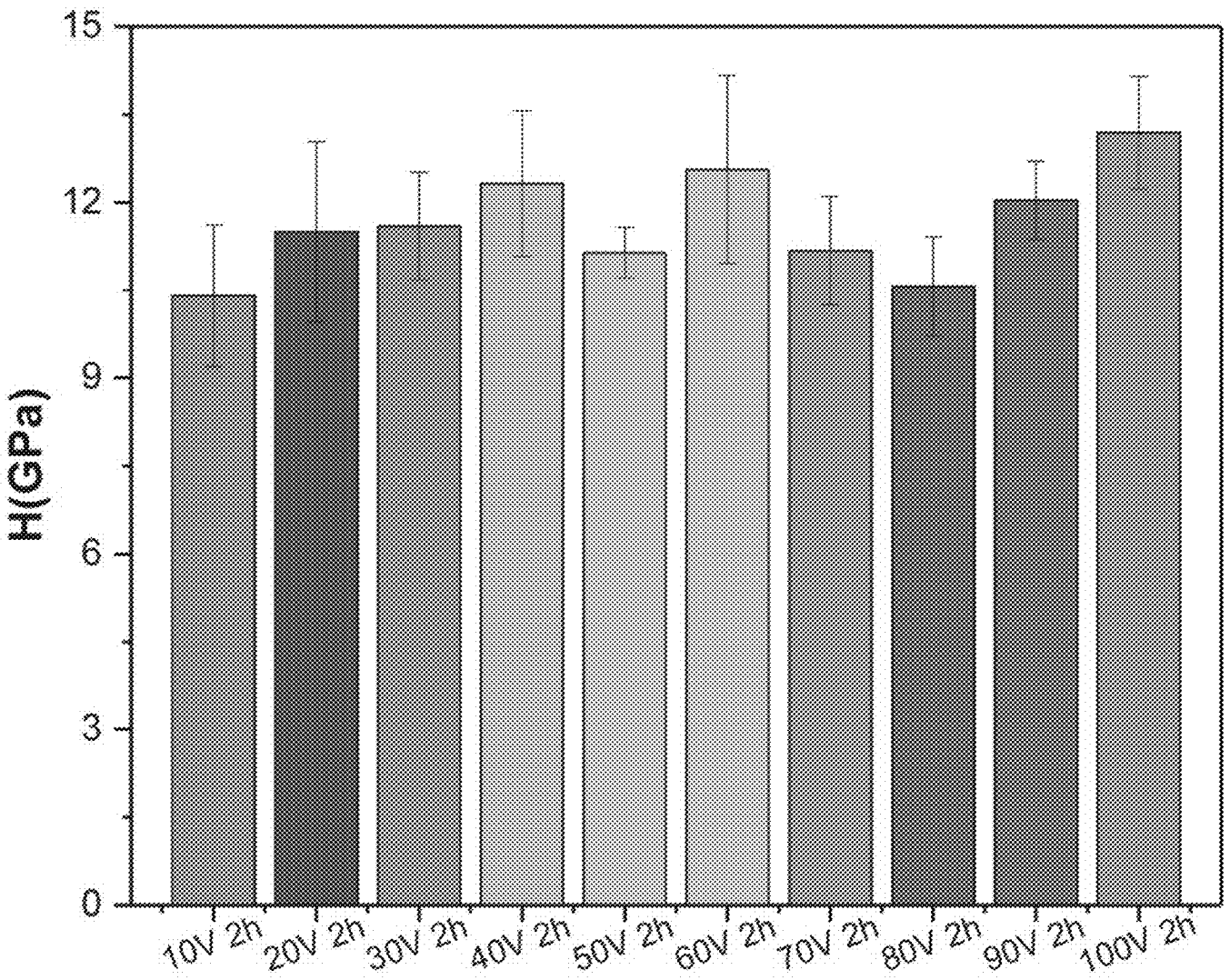
FIG. 5*a* is a graph illustrating the hardness of $TiAlVO_x$ ESOs obtained at different anodization potentials ranging from 10-100 V.
Figure 5B:
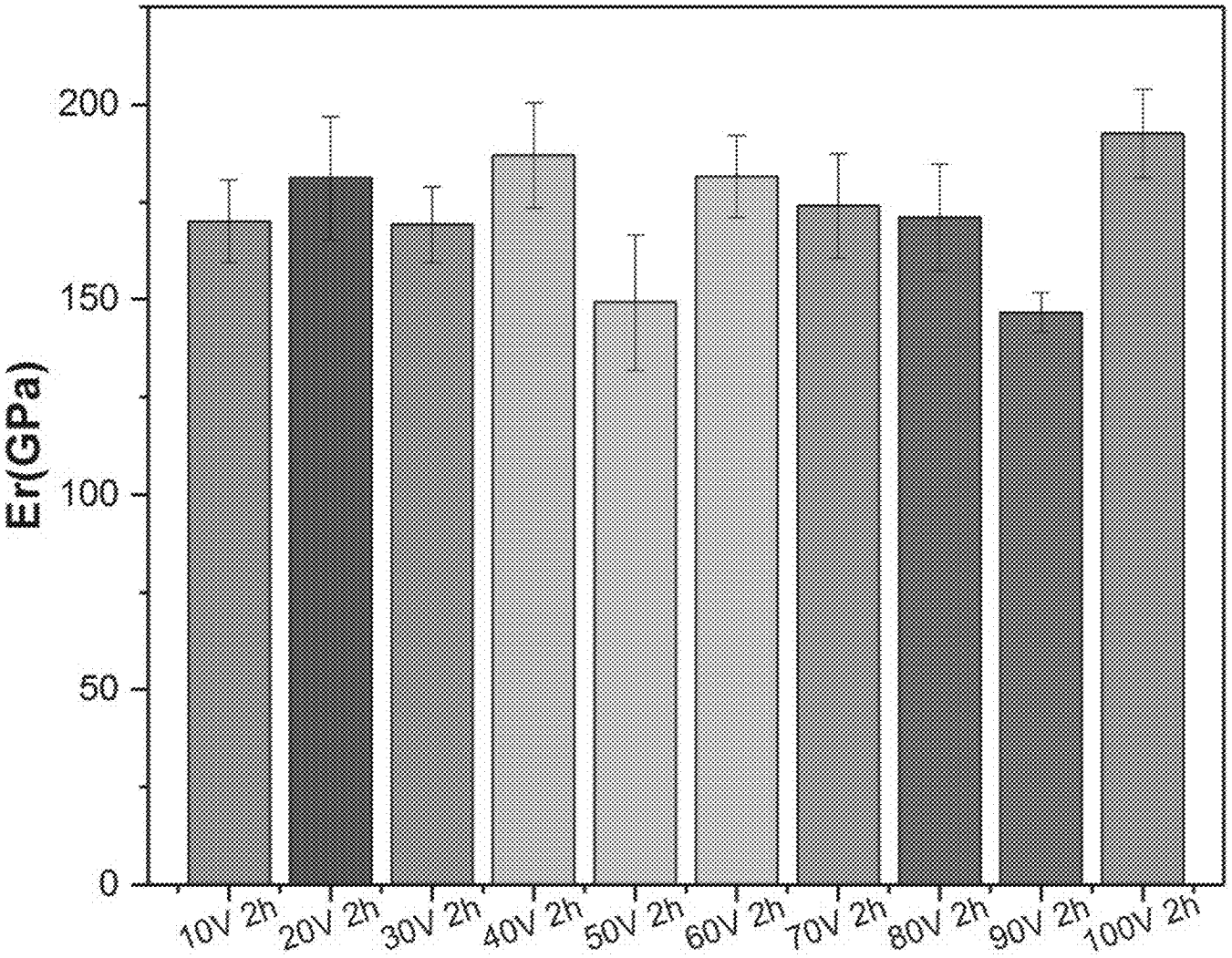
FIG. 5*b* is a graph illustrating the reduced modulus of $TiAlVO_x$ ESOs obtained at different anodization potentials ranging from 10-100 V.

Referring to FIGS. 5*a* to 5*b*, the nano-indentation test shows that the hardness (H) of the mesoporous entropy-stabilized ceramic film 100 is in the range of 9 to 14 GPa, while the reduced Elasticity Modulus (Er) is in the range of 140 to 190 GPa. The variable mechanical performance of the entropy-stabilized ceramic 104 greatly depends on the morphologies e.g. pore size, ligament thickness and porosity of the obtained mesoporous entropy-stabilized ceramics. Overall, the as-prepared entropy-stabilized ceramic films 100 exhibit excellent mechanical properties; they are hard and stiff in nature.

Advantageously, the present invention provides an economical and efficient anodization method for producing entropy-stabilized ceramic coatings. It aims to reduce the present fabrication cost of entropy-stabilized ceramics and enable a wide range of new entropy-stabilized oxides. By tuning the anodization parameters, entropy-stabilized ceramics films can be formed directly on the surface of entropy-stabilized alloys.

Advantageously, as the present invention is directed to a solution-based method, it would be highly compatible with various industry applications. The physical property of the entropy-stabilized ceramic films 100 obtained from such fabrication method is favourable and thus may realise their practical applications. For instance, the entropy-stabilized ceramic films 100 fabricated by the present invention are of high qualities, possessing remarkable mechanical, anticorrosion, and physical properties, and interesting optical features where the film color can be readily fabricated over a wide range of the visible spectrum.

Advantageously, the entropy-stabilized ceramics 104 grown on the substrate 102 of entropy-stabilized alloys also display excellent chemical stability. Protective and decorative layers formed by the present invention is therefore suitable for applications under extreme environmental conditions.

From the microscale perspective, the mesoporous features of the fabricated entropy-stabilized ceramic films 100 may also be used for sensing, photocatalysis and charge storage. In addition, the pores 108 may also serve as an effective host for foreign species such as trapping a variety of molecules e.g., catalysts, dyes, or magnetic species. Advantageously, this leads to versatile functionalities of the fabricated entropy-stabilized ceramic films 100 apart from protective and decorative purposes.

Advantageously, the present invention may support the fabrication of film with large area. As the surface of the entropy-stabilized alloy is shaped to form the cathode and is in a direct anodization with anion, the physical property of the film may be controlled precisingly and the fabricated film possesses high uniformity throughout the anodizing surface. Accordingly, the present invention is highly compatible with mass production on an industrial scale.

It will be appreciated by persons skilled in the art that numerous variations and/or modifications may be made to the present invention as shown in the specific embodiments without departing from the spirit or scope of the invention as broadly described. The present embodiments are, therefore, to be considered in all respects as illustrative and not restrictive.

It will also be appreciated by persons skilled in the art that the present invention may also include further additional modifications made to the method which does not affect the overall functioning of the method.

Any reference to prior art contained herein is not to be taken as an admission that the information is common general knowledge, unless otherwise indicated. It is to be understood that, if any prior art information is referred to herein, such reference does not constitute an admission that the information forms a part of the common general knowledge in the art, any other country.

The invention claimed is:

1. A method for preparing an entropy-stabilized ceramic that is hard and stiff in nature, comprising the steps of:

anodizing a substrate comprising an entropy-stabilized alloy, the entropy-stabilized alloy is made of raw materials provided in equal atomic ratios being selected from three or more of Titanium, Aluminum, Vanadium, Chromium and Niobium in a two-electrode cell including an anode with the substrate, a cathode, and an electrolyte comprising oxalic acid, with an anodization potential of 10V to 100V for a duration of several minutes to several hours;

forming the entropy-stabilized ceramic on the substrate as a coating, wherein the entropy-stabilized ceramic is an amorphous near-equimolar oxide with a mesoporous structure; and wherein the entropy-stabilized ceramic has a hardness between about 9 GPa to about 14 GPa and has a reduced modulus between about 140 GPa to about 190 GPa.

2. The method according to claim 1, wherein the raw materials have a high purity of >99.99%.

3. The method according to claim 1, wherein the entropy-stabilized ceramic is tightly bonded to the substrate.

4. The method according to claim 1, wherein the mesoporous structure includes a pore size of 10 to 50 nm.

5. The method according to claim 1, wherein the entropy-stabilized alloy is selected from TiAlV, TiAlVCr and TiAlVNbCr.

6. The method according to claim 1, wherein the entropy-stabilized ceramic has a visible color.

7. The method according to claim 6, wherein color of the entropy-stabilized ceramic depends on the anodization potential.

8. The method according to claim 1, wherein pore size of the entropy-stabilized ceramic depends on the anodization potential.

9. The method according to claim 1, wherein the anodizing is performed for 2 hours.

10. A method for preparing an entropy-stabilized ceramic film that is hard and stiff in nature, comprising the steps of:

anodizing a TiAlV substrate using a two-electrode cell that includes an anode with the TiAlV substrate, a cathode, and an electrolyte comprising oxalic acid, with an anodization potential of 10V to 100V for a duration of several minutes to several hours;

forming the entropy-stabilized ceramic film made of $(TiAlV)O_x$ directly on the TiAlV substrate, wherein x is an integer, wherein the entropy-stabilized ceramic is an amorphous near-equimolar oxide with a mesoporous structure; and wherein the entropy-stabilized ceramic that is hard and stiff in nature has a hardness between about 9 GPa to about 14 GPa and has a reduced modulus between about 140 GPa to about 190 GPa.

* * * * *